US005259593A

United States Patent [19]

Orme et al.

[11] Patent Number: 5,259,593

[45] Date of Patent: Nov. 9, 1993

[54] APPARATUS FOR DROPLET STREAM MANUFACTURING

[75] Inventors: Melissa E. Orme, Los Angeles; Eric P. Muntz, Pasadena, both of Calif.

[73] Assignee: University of Southern California, Los Angeles, Calif.

[21] Appl. No.: 868,883

[22] Filed: Apr. 16, 1992

Related U.S. Application Data

[62] Division of Ser. No. 575,271, Aug. 30, 1990, Pat. No. 5,171,360.

[51] Int. Cl.[5] ..... B29B 9/00; B22F 9/00

[52] U.S. Cl. ..... 266/78; 75/331; 75/346; 264/9; 425/6

[58] Field of Search ..... 75/331, 346; 264/9; 425/6; 266/78

[56] References Cited

U.S. PATENT DOCUMENTS

| | | | |
|---|---|---|---|
| 4,302,166 | 11/1981 | Fulwyer et al. | 425/6 |
| 4,788,016 | 11/1988 | Colclough et al. | 425/6 |
| 4,956,128 | 9/1990 | Hommel et al. | 264/9 |
| 4,981,425 | 1/1991 | Lierke et al. | 425/6 |
| 4,981,625 | 1/1991 | Rhim et al. | 425/6 |
| 5,032,172 | 7/1991 | Overfelt et al. | 148/513 |
| 5,054,539 | 10/1991 | Keutgen et al. | 164/46 |
| 5,147,448 | 9/1992 | Roberts et al. | 264/9 |

OTHER PUBLICATIONS

Orme et al. Rev. Sci. Instrum., 58 (1987) 279-284.

*Primary Examiner*—Upendra Roy
*Attorney, Agent, or Firm*—Harris, Kern, Wallen & Tinsley

[57] ABSTRACT

A method of manufacture of a net form product, including directing a stream of liquid from a nozzle onto a collector of the shape of the desired product, applying a disturbance to the stream, preferably an amplitude modulated disturbance, to produce a droplet stream, and with the nozzle and collector in a chamber, controlling the chamber environment. An apparatus for manufacturing a net form product having a source of molten material under pressure, a support for positioning a product collector in a chamber with the collector defining a desired product, a droplet stream generator positioned within the chamber and including a nozzle, a conduit for conducting molten material from the material source to the generator nozzle, a mechanism, typically a modulator, for disturbing the droplet stream, and a drive mechanism for relative movement of the nozzle and support.

19 Claims, 4 Drawing Sheets

APPARATUS FOR DROPLET STREAM MANUFACTURING

This application is a division of application Ser. No. 07/575,271, filed Aug. 30, 1990, now U.S. Pat. No. 5,171,360.

BACKGROUND OF THE INVENTION

The present invention relates to a new method and apparatus for constructing precision net form components as well as simpler forms with precisely controlled streams of material, droplets in a background gas ranging from vacuum to above atmospheric pressures where the size, energy and rate of arrival of the droplets as well as the pressure and type of background gas can all be adjusted to optimize the construction and material properties of the component.

Conventional casting consists of pouring or injecting molten metal into a mold at a rate which is faster than the solidification rate. This well known procedure is suitable for the high volume production of small simple parts with reasonably uniform dimensions. However, several deficiencies in conventional casting has lead the metallurgy industry to research new techniques of materials processing. For example, in conventional casting segregation occurs in the production of most alloys. Also, it has been found that since the solidification time for casting is long, differences in the composition of the metallic part can occur.

Powder metallurgy (P/M) is a well established production process in which parts are made by compressing metal powders in a mold. Subsequent sintering (heating) is necessary to bond the particles to give the formed material strength and other desirable properties. The powder needs to be contained and formed by dies. The advantage of powder metallurgy is that metals which are difficult to melt and to cast such as tungsten and tantalum can be economically fabricated by the P/M process. It can also be used to produce non-metallic parts. Generally speaking, P/M involves the steps of mixing, compacting and sintering. Further steps are often taken to improve the structural soundness of the P/M part such as infiltration and repressing. Strengths of the P/M process include the ability to fabricate complex shapes, the ability of precise material control or unusual material composition, and the ability of mass production. However, due to the nature of the P/M process, it is restricted to relatively small components. Further, the cost of the powder may limit the feasibility of P/M manufacturing to a narrow range of applications.

A new method of manufacturing called net form manufacturing is currently the topic of industrial as well as academic interest. Powder metallurgy is viewed by some researchers to be a type of near net form manufacturing even though additional manufacturing processes are required to assure structural strength after the part has been formed in the mold.

Net form manufacturing refers to that process where the final, or near final engineering part is made from the raw material in one integrated operation. Subsequent working is not required to enhance the structural qualities of the net formed part. For instance, in the developing technology of spray forming, a spray of molten metal is used as the manufacturing constituent to fabricate a part in its near net form. The spray is achieved by bombarding a stream of molten metal with an atomizing or nebulizing gas. Thus, the presence of the atomizing gas in the manufacturing environment is a required (though not necessarily desirable) feature of the currently developed technique of spray forming. The spray droplets travel in the gas environment and are deposited onto a collector. Either the collector or the spray may be moved so that the deposit is constructed in the desired shape. The molten metal droplets arriving at the solidifying surface remain where they are delivered, thus there is no need for a mold. The surface consists of a thin liquid film just a few microns thick. Once the droplets impinge on the surface they "splat," as if they had impinged on a solid surface. The splatting action causes the boundaries between the surface and the drop (splat) to disappear as the fluids mix. The splat solidifies almost immediately, thus prohibiting any significant lateral migration. It has been found that the material properties of the product depends on the splatting conditions. In spray forming, the near net formed part is processed further in order to achieve the characteristics of the final finished piece. Thus, spray manufacturing is termed here as near net manufacturing. Regardless of this detail, under careful conditions, the material structure of the final form will have a finer grain than those parts conventionally cast, and will be free of macroscopic segregation. Segregation, if any, will occur on the scale of a splat diameter. The combination of low segregation and fine grain size yields a product with enhanced mechanical properties. Moreover, since there are fewer manufacturing steps than in conventional processes, the production costs can be reduced.

See "The Osprey Preform Process," *Powder Metallurgy*, 1985, vol. 28, no. 1, pp. 13–20 for additional information on spray forming.

While it is clear that spray forming offers significant improvement over conventional processes in certain applications, there are several deficiencies present which may be overcome by using different methods. For example, the spray of molten metal droplets is for the most part uncontrolled. The droplets within the spray cone have a wide distribution of sizes and energies which can only be described statistically. This means that the smaller droplets may arrive at the surface presolidified, and there would be little cohesion between the particles in the deposit, resulting in an inhomogeneous material. Also, the dimensional fidelity of the net form part is limited by the lateral extent of the conical volume of particles. Smaller intricate parts cannot be made with this method without further work. And, due to the nature of the spray process, it is inevitable that overspray will occur, and that there will be high losses from scrap. The final deficiency noted is that the deposition environment is coupled with the atomizing technique, therefore making it impossible to fabricate materials in a vacuum environment, or an environment which is independent from the atomizing gas. It is submitted that use of controlled streams of droplets that are generated without the use of an atomizing or nebulizing gas, instead of droplet sprays, will lessen if not remove the above deficiencies associated with spray forming, as well as to preserve the benefits of low cost and added strength.

It would be advantageous to have droplets arriving at the thin liquid surface with uniform and controllable size and temperature. Also, in many circumstances the background gas in the spray chamber can be trapped in the solidifying material. Thus, decoupling the size and speed of the droplets from the background gas supply provides an opportunity to optimize the droplet deposition process in order to produce the highest quality materials. An ability to have a vacuum or reduced pressure gas as the background would be advantageous in removing the problem of trapped gases or gases in solution. Finally, in some circumstances, controlled amounts of reactive gases in the background may enhance the properties of the deposited materials.

As will be described in more detail below, net form manufacturing with liquid molten metal drops is found to alleviate many of the hindrances encountered in conventional manufacturing processes, as well as to increase the structural integrity of the part. It is an object of the present invention to provide a method and apparatus for such net form manufacturing.

Recent research has lead to the precise control of droplet stream generation. Precise control refers to the ability to generate a stream of droplets with speed differences as small as $1\times10^{-7}$ times the average droplet velocity, and angular deviations of the stream of typically a few times $1\times10^{-6}$ radians. Further, precise control refers to the ability to manipulate the configuration of the stream of droplets by adjusting an input disturbance to the droplet generator. It has been found that the fluid stream from which droplets are formed responds to the applied disturbance almost instantaneously (on the order of one disturbance wavelength). This means that a stream of droplets can be generated which are either very uniform ($1\times10^{-7}$ times the average droplet velocity), or have a predictable and highly controllable size and spacing distribution. It is another object of the present invention to provide a method and apparatus for use of these streams in production of net forms, a process sometimes referred to as precision droplet stream manufacturing, or PDSM.

The general phenomenon of capillary stream break-up in the break-up of a liquid jet should be considered. The controlled instability of a fluid stream is introduced by disturbing the stream, as by vibrating the stream with a sinusoidal, triangular or other periodic waveform. When a fluid stream is disturbed with a disturbance, the stream breaks into a series of droplets, preferably equally spaced droplets which are separated a distance corresponding to the wavelength of the disturbance. The resulting stream of droplets is separated a distance which corresponds to the wavelength of the disturbance.

A different break-up process occurs if the stream is perturbed with an amplitude modulated disturbance. FIGS. 1*a* and 1*b* are representations of the response of the stream when perturbed with an amplitude modulated disturbance based on the present understanding of the phenomenon. The stream condition at various times $t_1$–$t_7$ of FIG. 1*a* is shown in FIG. 1*b*. A disturbance is imposed on the stream and it grows until the stream begins to break. It continues to break until the situation illustrated as $t_5$ is reached. The droplets in this configuration are separated a distance corresponding to the wavelength of the fast or carrier frequency, and are thus termed "carrier" droplets. Unlike conventional droplets, i.e., droplets generated with a single frequency disturbance, the carrier droplets generated by the amplitude modulated disturbance have a predictable relative speed component. The carrier droplets with their corresponding relative speeds are illustrated in configuration $t_5$ in FIG. 1*b*. The predictable relative speed component should not be confused with the unpredictable speed fluctuations that are measured as speed dispersions. The relative speed components are a direct consequence of the amplitude modulated disturbance waveform. That is, since the radial amplitude of the stream at the forward and rearward extremes of the potential drop are not symmetric, the break times of the extremes will be different, resulting in a net impulse, or speed change on the drop. Thus, the value of relative speed component depends on the degree of modulation of the disturbance; a highly modulated disturbance will yield a higher value and vice versa. The nature of the component is that it forces the carrier drops to coalesce systematically into larger drops as illustrated by $t_7$ in FIG. 1*b*. The merging time, or the time represented by drops at $t_7$ is always much greater than the break time of the droplets represented by $t_5$, the time required to break into uniformly spaced carrier droplets. The merging time is predictable. The final drops are separated a distance commensurate with the wavelength of the slow or modulation frequency of the disturbance, and hence are called "modulation" drops. The modulation drops are much more uniform in spacing and have smaller speed dispersions than drops generated with a conventional single frequency disturbance. It should also be noted that the separation between droplets increases linearly with the frequency ratio N. A frequency ratio of 1 is defined here as a conventional single frequency disturbance. It has been found that as the frequency ratio increases, the velocity dispersion decreases approximately as 1/N.

See "New technique for producing highly uniform droplet streams over an extended range of disturbance wave numbers," *Review of Scientific Instruments* 58 (2) Feb., 1987, pp. 279–284, and "Applications to Space Operations of Free-Flying Control Streams of Liquid," AIAA85-1029 and the paper of the same title in *Journal of Spacecraft*, Vol 23, No. 4, Jul.-Aug., 1986, pp. 411–419, for additional information on production of droplet streams with amplitude modulation.

SUMMARY OF THE INVENTION

A new method and apparatus have been conceived for the processing of materials in their net form. The process is characterized by the use of precisely controlled streams of liquid droplets, i.e., precision droplet stream manufacturing or PDSM. PDSM is related to the technology of spray manufacturing which is currently under development by others.

In spray manufacturing, the near net form product is achieved with the use of a spray of molten metal. The spray particles are deposited onto a collector and subsequently undergo rapid solidification. The reasons why this and other forms of net form manufacturing are beneficial are two-fold. First, because the route from the raw material to its final or near final shape is shortened, the manufacturing costs are reduced,, and second, because of rapid solidification, the mechanical properties of the final net form are enhanced over those parts manufactured by conventional methods. In true net form manufacturing, the final part is achieved through one integrated procedure. The dimensional fidelity of the near net formed part is limited by the size of the spray cone. Other shortcomings of spray manufacturing include the uncontrollable nature of the sizes and speeds of the droplets within the spray which leads to a less homogeneous part, as the smaller droplets will cool faster and may pre-solidify before deposition. Overspray and losses due to scrap are further weaknesses of spray forming.

In contrast, the deposition process of the present invention is achieved with precisely controlled streams of liquid droplets, where the speeds and sizes of the droplets are predetermined and easily varied. Due to this character of the invention, the resolution of the net formed parts is limited only by the droplet size, and can be as low as about two times the diameter of the liquid stream from which the droplets are formed. Along with increased resolution, the net formed part is more homogeneous since each drop is the same size, and thus there is no distribution in cooling rates. Losses from overspray are reduced due to excellent directional control of the stream of droplets. Thus, the newly conceived technique of the invention is expected to overcome the shortcomings associated with spray forming as well as maintain, if not enhance, the benefits associated with net form manufacturing.

The technique of generating streams of drops in a vacuum environment which are more uniform and more controllable than those generated with spray methods is used in the present invention. Droplet speed variations as small as $1\times10^{-7}$ times the average droplet speed can be easily achieved when using this technique. Other droplet stream configurations, where the spacing and the size of each droplet in the stream can be varied in a predictable and controllable manner can be achieved by amplitude modulation.

In precision droplet stream manufacturing droplet generation and subsequent propagation can take place either in a vacuum environment in order to fabricate a net form free of embedded gases, or in a regulated inert atmosphere for controlling the properties of the solidified material. Specific examples of PDSM are illustrated in FIGS. 2, 3, 4 and 5. In each case, the genesis of the droplets is due to capillary stream break-up. Stagnation pressure is applied to the liquid material and drives the fluid flow through the nozzles of the droplet generator. A fluctuating pressure component, such as a simple non-amplitude modulated form and preferably in the form of an amplitude modulation, applied near the nozzle with a piezoelectric crystal or other actuator such as an electromagnetic vibrator, initiates a disturbance on the fluid column. The resulting droplet stream essentially "mimics" the form of the applied disturbance, with a response time of the order of one wavelength of the disturbance waveform. The droplets are deposited onto a collector before they solidify. Subsequent rapid solidification causes the deposit to have a uniform structure which is virtually free of segregation. Alloys also may be produced with the method and apparatus of the invention.

The invention also comprises novel details of construction and method steps, and novel combinations and arrangements of parts and steps, together with other objects, advantages, features and results which will more fully appear in the course of the following description.

DESCRIPTION OF THE PREFERRED EMBODIMENTS

Figure 2:
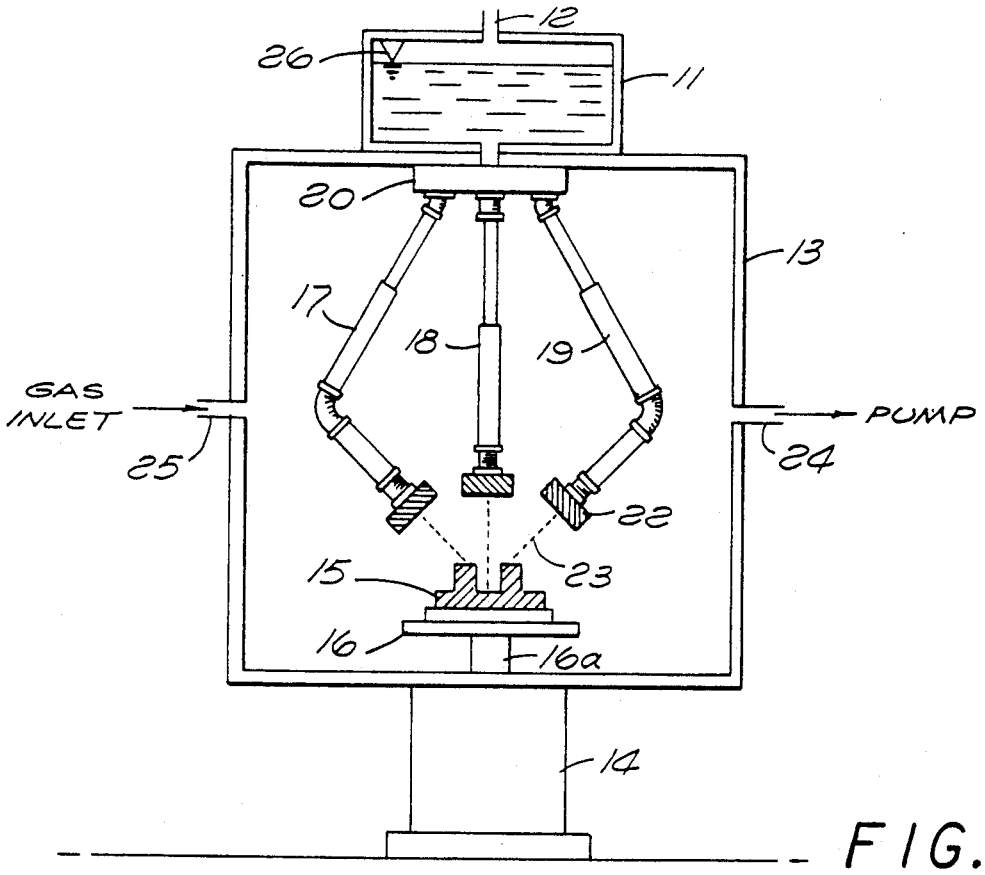
FIG. 2 illustrates an apparatus utilizing a plurality of single stream generators in production of a multiple faceted shaped part and incorporating an embodiment of the invention.

The apparatus of FIG. 2 uses a plurality of single droplet stream generators for the manufacture of a net form product on a collector, and is especially suited for producing a multiple faceted part. The collector may define a desired shape, such as that shown in FIG. 2, or may be a flat plate or the like on which the product is built up by stream control.

The source for the streams is a tank 11 of material in liquid form. A pressure source is connected at the tank at inlet 12 to provide for flow of the material from the tank 11 into a manifold 20 and then into one or more robotic arms 17, 18, 19. The liquid material desirably has a viscosity less than about 200 centipoise. Typical materials include molten metals such as aluminum, iron and alloys, and various epoxys.

The arms 17, 18, 19 are positioned within a chamber 13 which may be supported on a stand 14, with a collector 15 carried on a base 16 within the chamber. The collector may be used to define the shape of the net form product to be produced. Each of the robotic arms includes a droplet stream generator 22 with a nozzle which produces a single stream 23 of droplets. The environment within the chamber 13 may be controlled by a vacuum pump connected at an outlet 24 and a gas source connected at an inlet of 25. A sensor 26 for a liquid level controller may be mounted in the tank 11 if desired. Each generator includes means for producing a disturbance in the stream, preferably a modulator, such as that described in the aforementioned paper in *Review of Scientific Instruments*, or in the article by Orme and Muntz in *Physics of Fluids A*, vol. 2, no. 7, Jul. 1990, pages 1124–1140.

Conventional means for driving the base 16 along x, y and z axes may be included in or adjacent the base-to-chamber support 16*a*, as desired. Conventional means for driving each of the robotic arms along x, y and z axes may be mounted in the chamber at or adjacent the tank 11, as desired.

In operation, the liquid material is forced from the tank 11 to the manifold 20 and the arms 17, 18, 19 to the generator nozzles 22. The arms may be moved to direct the droplet streams over the surfaces of the collector. Also, the collector support base 16 may be moved to vary the aiming points of the streams 23.

The droplet streams are generated by a disturbance, preferably periodic and amplitude modulated, and may be constructed and operated in the manner disclosed in the aforementioned publications. The embodiment of FIG. 2 is especially suited for making smaller detailed parts. The single streams of liquid droplets are directed by the robotic arms onto the deposit on the collector. Rapid and incremental solidification occurs as each droplet arrives at the deposit. Successive droplet depositions build the near or final form. Since the angular spread of a single stream of liquid droplets is of the order of $1\times10^{-6}$ radians, the resolution of the detailed part is limited by the size of the droplet deformation upon impact. In the related technology of spray forming, the deformed droplet has been termed a "splat." Splat dimensions currently used in spray manufacturing are typically 400 micrometers in diameter and 14 micrometers thick originating from a 150 micrometers droplet. In the system of the present invention, the splat size will depend on the droplet speed and viscosity, and will be in the order of a few times the droplet diameter.

The shape and location of the inlet 25 and/or the outlet 24 can be selected to enhance the net form manufacturing. The inlet 25 may include one or more lines and nozzles to direct a gas or vapor stream onto the product being formed for cooling the surface of the product. The inlet 25 could be an annular slot or a series of orifices facing the droplet stream as well as a single opening, and could be used to expose the droplets to a desired environment for cooling, reacting with and/or slowing down the droplet stream in a controlled manner.

Figure 7:
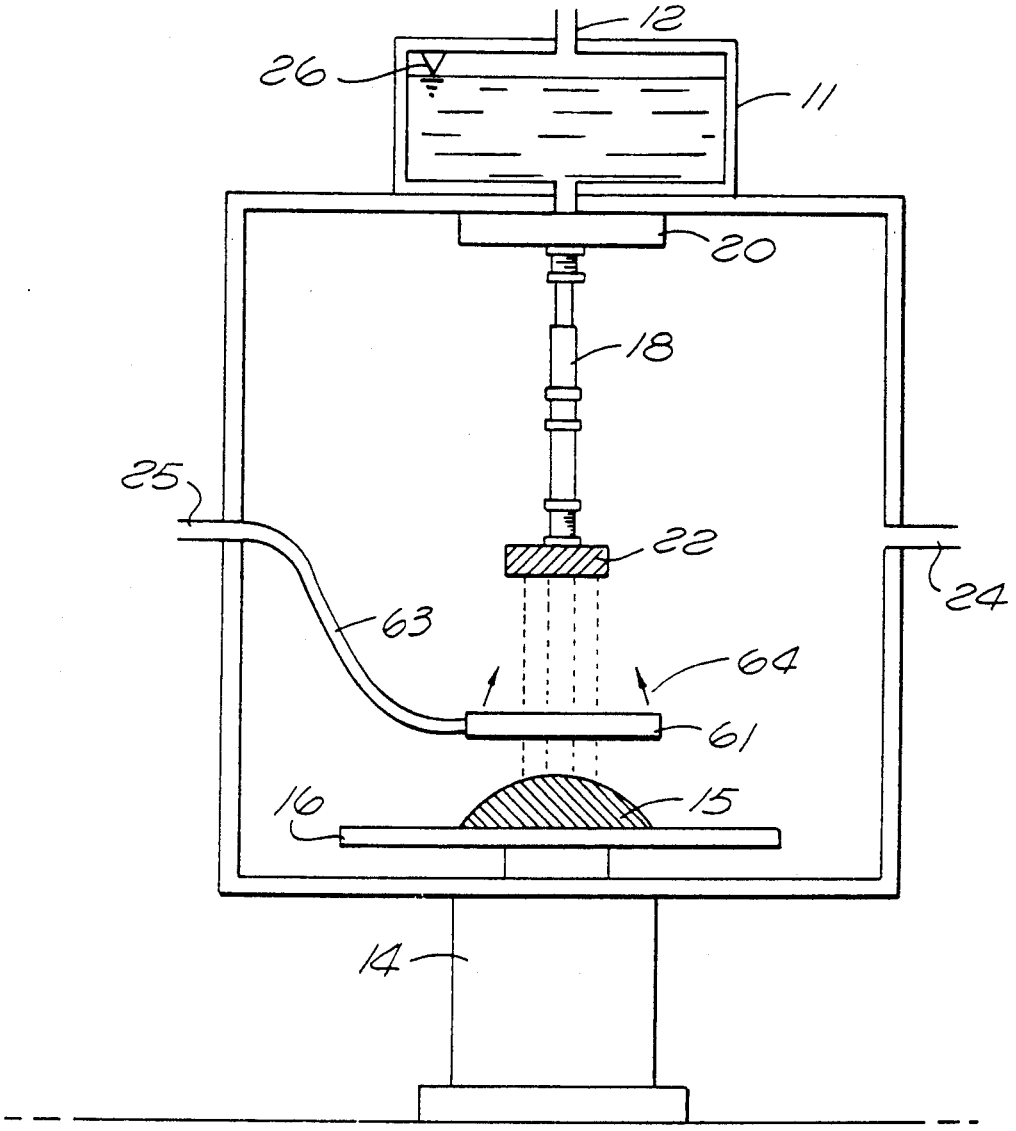
FIG. 7 is a view similar to that of FIG. 2 illustrating another alternative embodiment of the invention using a deceleration gas.
Figure 8:
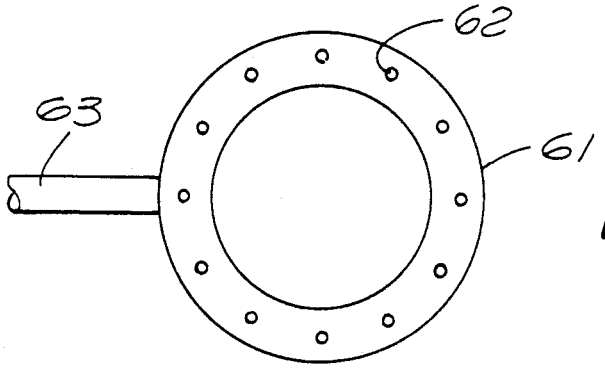
FIG. 8 is a top view of the gas ring of the embodiment of FIG. 7.

One such arrangement is shown in FIGS. 7 and 8. A ring 61 is positioned in the chamber 13 between the generator 22 and the collector 15. The ring is hollow and has a plurality of openings 62 in the upper surface. The inlet 25 is connected to the interior of the ring by a line 63. A gas supply connected to the inlet 25 will provide a plurality of jets 64 of gas directed upward and inward around the droplet stream or streams from the generator 22. An annular slot can be used in place of the individual openings 62. The jets 64 can be directed toward the collector as well as toward the generator, or only toward the collector, as desired.

Figure 3:
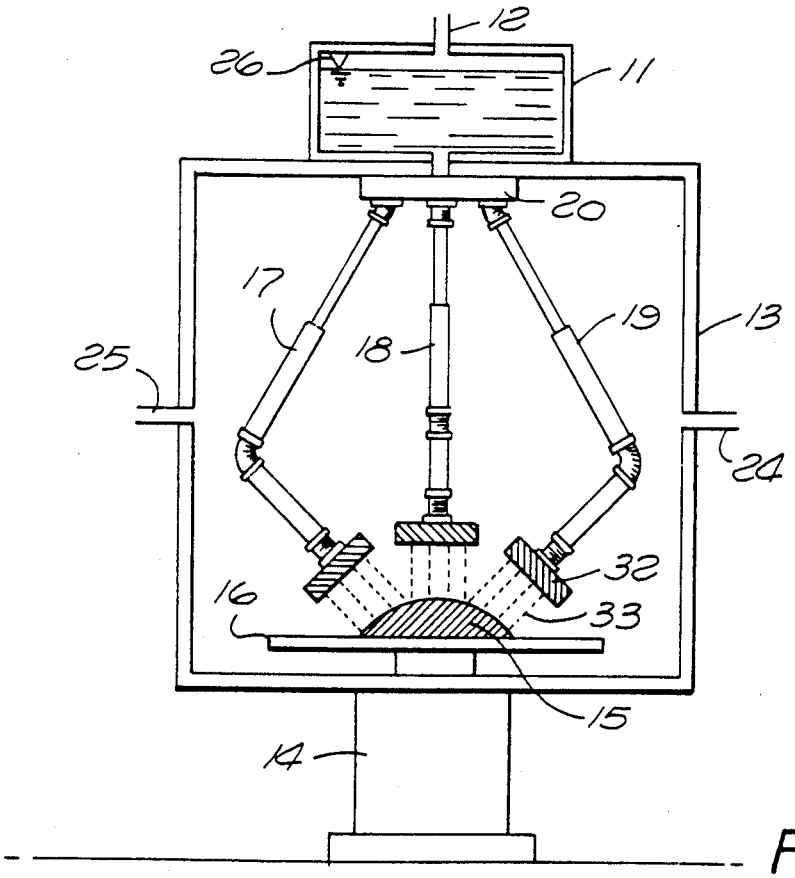
FIG. 3 illustrates an apparatus similar to that of FIG. 2 utilizing multiple stream generators in production of a hemispherical part and incorporating the presently preferred embodiment of the invention.

An alternative embodiment of the invention is shown in FIG. 3, using stream generators 32 each of which produces an array of parallel streams 33.

This embodiment is better suited for making large bulk products. Each array generator may have several hundred nozzles with a separation of five to ten nozzle diameters for maximum material throughput. The angular spread of the array of streams can limit the resolution of the net form product. Current state of the art nozzle array fabrication can produce nozzle arrays with an angular spread in the order of $1\times10^{-3}$ radian.

Figure 4:
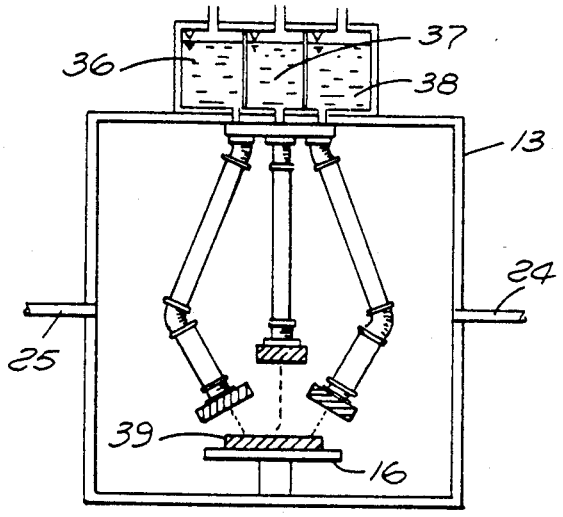
FIG. 4 is a view similar to that of FIG. 2 illustrating an alternative embodiment of the invention utilizing different liquid materials.

Another alternative embodiment is shown in FIG. 4. This embodiment utilizes a plurality of tanks for different liquid materials, three tanks 36, 37, 38 being shown in FIG. 4. Each tank is connected to a separate arm and generator, permitting the application of three different materials in controlled areas of the collector. Also this arrangement with a plurality of material sources can be used for producing alloys, such as aluminum-copper-zinc, nickel-chromium-magnesium, aluminum-silicon and aluminum-copper.

Figure 5:
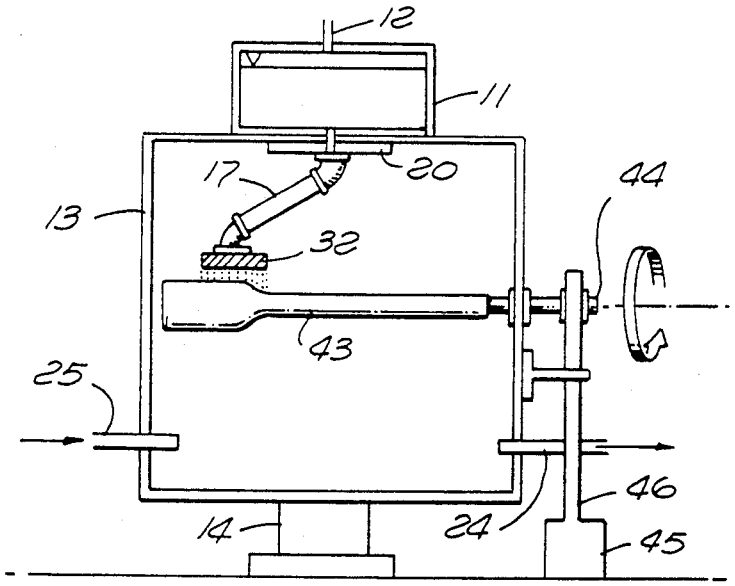
FIG. 5 illustrates another alternative embodiment of the invention suitable for producing products of generally tubular shape.

Another alternative embodiment is shown in FIG. 5. This embodiment is particularly suited for producing tubular products and other products of revolution. A collector 43 is supported on a rotating shaft 44 mounted in the wall of the chamber 13. The shaft is driven by a motor 45 and drive chain or belt 36.

One or more droplet streams are provided from a generator which is moved along the collector as the collector is rotated to produce the product in the desired shape. In all of the embodiments, when the product shape permits, the collector and product can be separated. In other instances, because of the configuration of the finished product, the collector can be removed from the net form product by melting, burning, chemical dissolution or the like.

FIGS. 2-5 illustrate embodiments of the use of precisely controlled droplet streams to net form manufacture parts. Arrays of liquid droplet streams are used to build a part on a collector which can be mechanically translated, in a time dependent manner, to produce complicated forms. The angular dispersion of the droplet stream rays has been measured to be of the order of $1\times10^{-3}$ radians. The dispersion is due to limitations in currently developed methods of fabricating the nozzle arrays. The angular dispersion of a single stream of droplets has been measured to be of the order of $1\times10^{-6}$ radians. Thus, using multiple streams reduces the dimensional fidelity of the net formed part, although it allows increased material throughput.

FIG. 2 illustrates the use of single streams for fabricating smaller, more refined and intricate parts. The angular dispersion of the stream is of the order of $1\times10^{-6}$ radians In this embodiment, the resolution is dominated by the splat dimension, i.e., the dimensions of the deformed droplet after surface impact, and can be as good as 50 micrometers. Precise material build up is achieved through motion of robotic arms or the collector or both.

The choice of droplet stream configuration depends on other conditions involved in the manufacturing process. For example, if there are no impurities in the manufacturing environment or liquid material the boundaries of the splats will be obliterated if they impinge on a thin film of material. In this case, uniformly sized drops are desirable so that the droplets have uniform cooling rates, and prevent pre-solidified droplets from impacting on the surface. Droplets which have solidified before impact will retain their identity, and the structure of the net formed material will be porous and inhomogenous. If there are impurities in the ambient environment, then it is desirable to have a distribution of droplet sizes. This is because the impurities cause the splat boundaries to retain their identity, and smaller droplets may be necessary to fill in the interstices of the material. However, the droplets cannot be so small that they have pre-solidified, which leads to a porous and inhomogeneous material. Precise control of the droplet stream configuration is an important feature of the method and apparatus of the invention. In the related technology of spray forming, a spray of molten metal droplets is deposited onto a collector, and precise control of the droplets sizes is not possible, leading to the occurrence of pre-solidified droplets embedded in the material.

The droplet generation of the present invention allows droplet deposition in an ambient environment which is either a vacuum, or a controlled reactive gas for surface conditioning of the deposit. A "vacuum" typically is at least $1\times10^{-5}$ torr. Typical reactive gases include chlorine, bromine, iodine, fluorine, oxygen and hydrogen. The present invention differs from the spray forming technology where the liquid stream is atomized by the use of inert gas which therefore is present in the deposition chamber and is therefore an unavoidable feature in spray forming. The method and apparatus also allows capability of manufacturing variable composition alloys of net form parts, and in-situ formation of composite materials. Resolution as good as 50 micrometers sets the present invention apart from existing technologies of net form manufacturing.

Figure 6A:
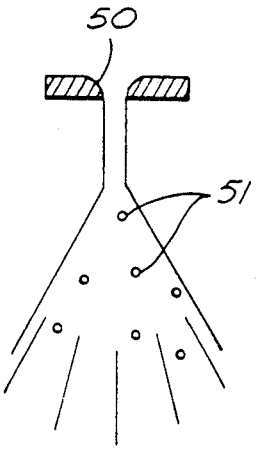
FIG. 6*a*, 6*b*, and 6*c* are diagramatic illustrations of the fluid dynamics of sprays and streams.
Figure 6B:
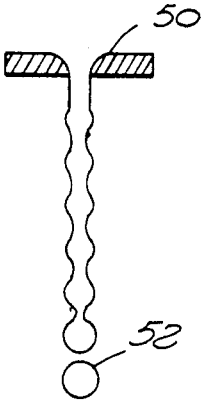
Figure 6C:
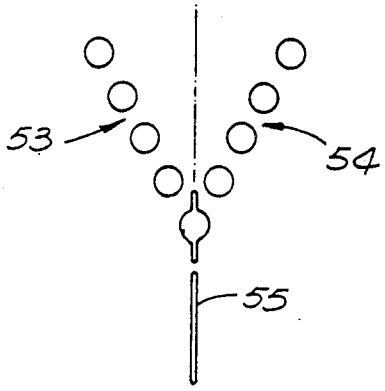

The dynamics of fluid in a space or vacuum environment is illustrated in FIGS. 6*a*, 6*b* and 6*c*. In FIG. 6*a* a stream of high vapor pressure passing through a nozzle or other apparatus 50 tends to bubble and burst into a diverging and uncontrolled cloud of droplets 51 and sometimes frozen particles. This is also the characteristic pattern encountered in spray forming.

Figure 1A:
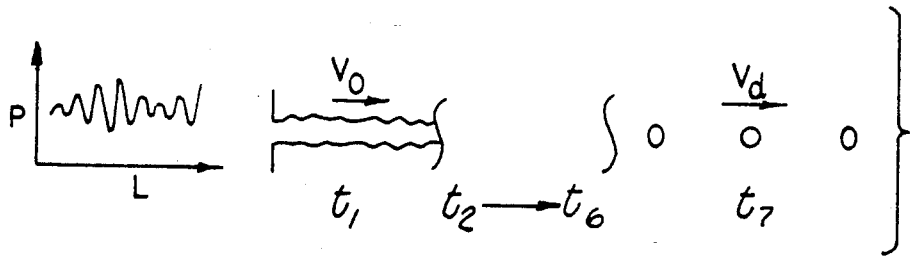
FIGS. 1*a* and 1*b* diagramatically illustrate the break-up and coalescence of an amplitude modulated capillary stream.
Figure 1B:
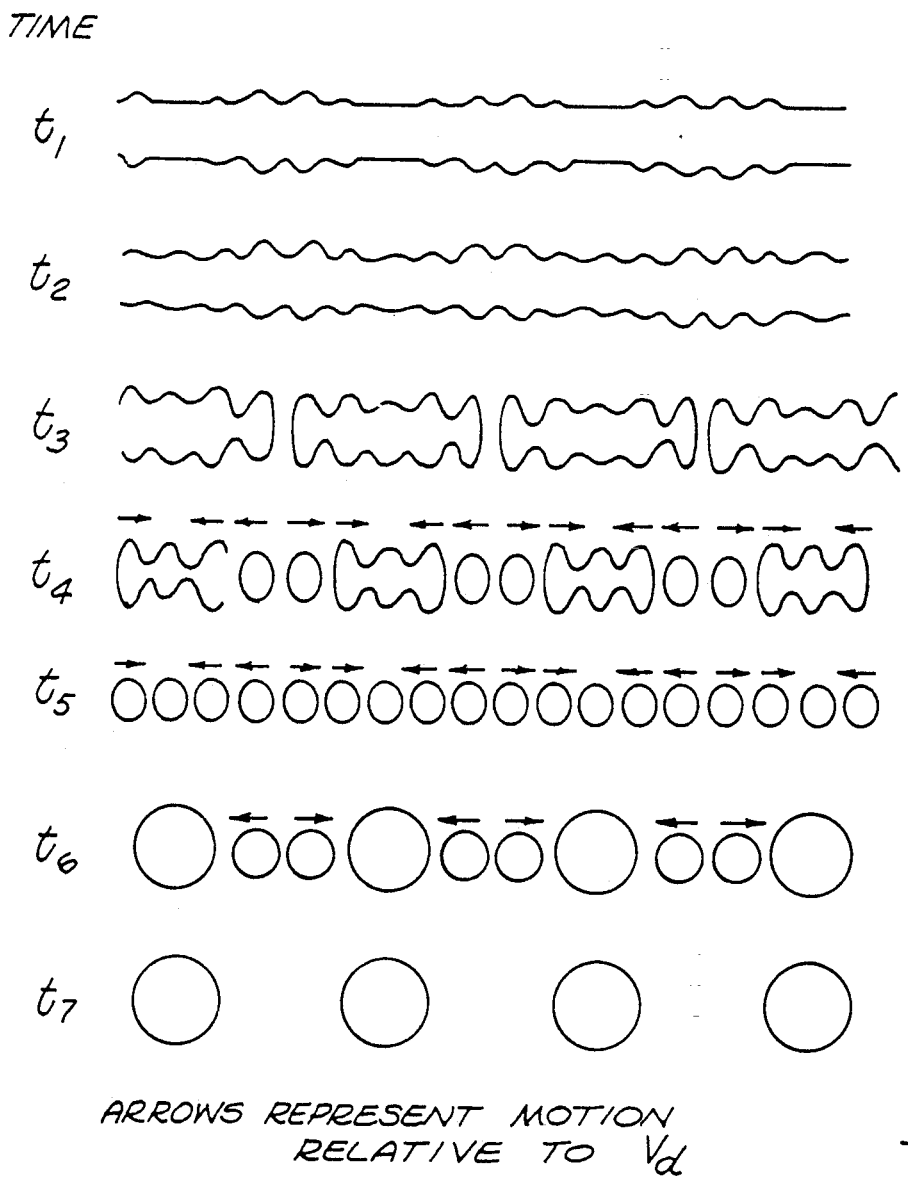

In FIG. 6*b*, a surface tension driven stream of low vapor pressure liquid breaks up into droplets 52 in the manner illustrated in FIGS. 1*a* and 1*b*.

In FIG. 6*c*, two droplet streams 53, 54 such as shown in FIG. 6*b*, collide to form flat disks generally perpendicular to the plane of the colliding streams.

Droplet collisions occur in the use of more than one stream of liquid droplets or the use of sprays. It has been found that by removing the effects of aerodynamics (i.e., by operation in a vacuum), droplet collision products are remarkably different than those in background pressures of one atmosphere. Two droplet streams composed of low vapor pressure fluid have been forced to coalesce in a vacuum, as illustrated in FIG. 6*c*. It has been found that if the relative impact velocity of the colliding drops is below a critical velocity, the product of the collision is a flat disk, oriented perpendicular to the pre-collision trajectories and the center to center vector at contact if the impact parameter (distance between line of centers of the pre-collision droplets) is zero. The fluid disk grows to diameters as large as $1\times10^3$ times the disk thickness. The disk then contracts back to a sphere with a diameter commensurate with the volume of the combine pre-collision droplet volumes. On the other hand, if the relative impact velocity is greater than the critical velocity, the thin disk continues to grow in diameter until it ultimately begins to shed fluid ligaments, followed by complete disruption. Collisions in a vacuum result in much thinner disks than can be achieved at background pressures of one atmosphere. It has been found that the impact parameter is an important factor which governs the collision product's shape, size and orientation.

Either the discs can be made to impinge on the surface or if the impact speed of two droplets is above a critical speed (typically in one case about 7 m/s for 200 micrometers diameter droplets of a low vapor pressure oil with a viscosity of 10 c.p.), the discs fragment into a shower of very small "collision" droplets typically $10^{-2}$ of the diameter of the originally colliding droplets. The shower of collision droplets is largely contained within a cone that is defined by the angle of intersection of the two colliding droplets streams assuming the streams have the same speed and same droplet diameter). The collision droplets take about 10 interdroplet spaces to be created after a collision. Under certain circumstances the spray of extremely fine collision droplets can be used to form a superior deposit due to their small size. Dimensional fidelity can still be good if the collision angle between the droplet streams is 10–20 degrees. Under these circumstances and say for 100 micrometer diameter colliding droplets, the spread of collision droplets is largely contained in a cone with a half-angle of say 10 degrees and thus after 10 droplet spacings (5 mm) the radius of the collision droplet spray cone is only about 50 micrometers. The collision droplets in the cone will have diameters around 1 micrometer. If the droplet streams are travelling at say 20 m/s, after collision the time before surface impact need only be about 250 microseconds. In this time the small collision droplets will not cool substantially.

The use of the amplitude modulated sinusoidal disturbance permits stable droplet formation at longer wavelengths or inter-droplet intervals than with an unmodulated disturbance or a single frequency disturbance. Since the controlled collision between droplets results in thin disks with diameters which have been measured to be up to about 20 times the diameter of the original droplet diameter, the fluid disks can overlap and coalesce if the pre-collision streams of droplets are spaced at wavelengths commensurate with that of a conventional single frequency disturbance. The thin disks can be used as an additional diameter control by having individual droplet streams collide before reaching the surface. The close control over droplet speeds made possible by the amplitude modulation and the good directional stability of individual streams permits one to have reliable collisions between droplet streams.

The present invention includes the following features: the use of one or more discrete droplet generators with single or multiple capillary streams that are parallel to $\pm5$ milliradian in each generator; a means for providing arbitrary disturbances on the surfaces of the streams and for directing each stream; a deposition chamber permitting environmental control, with pressure, type of gas, temperature and gas flow velocity and location all individually controllable; an environmental control system for the deposition chamber; directed deposition onto collectors at rates commensurate with maintaining a thin liquid surface layer on the component; precise control of droplet size permits adjusting cooling rate depending on background pressure and gas type; provision for reactive or nonreactive interactions with background gas, or in benign low pressure environment; use as control parameters, droplet temperature, droplet speed, droplet diameter, length of flight, background gas pressure and type; use of amplitude modulated excitation to control size of droplets, including generation of randomized size distribution; and use of interdroplet collisions to make thin disks before surface deposition.

Advantages of the present invention include: droplet "splats" undergo rapid solidification with high cooling rates; fine grain, low segregation, equiaxial structure with low porosity; enhanced bulk properties; shorter and more direct route from raw material to the finished product; stream which breaks into precisely sized droplets where the size can be controlled over a range of 10 to 1 or so from a single size orifice; droplet streams with speed dispersions as low as $1\times10^{-7}$ times the average droplet speed; angular dispersion of the stream of droplets typically $1\times10^{-6}$ radians; stationary or time dependent stream break-up for precise control of delivery rates; and generation of highly uniform polydispersed or monodispersed droplets at precisely controlled time intervals.

We claim:

1. In an apparatus for manufacturing a net form product, the combination of:

a source of liquid material under pressure;

a chamber;

a support for positioning a product collector in said chamber, said collector defining the shape of a desired product;

liquid droplet stream generator means positioned within said chamber, said generator means including a nozzle;

conduit means for conducting molten material from said material source to said generator nozzle;

disturbance means for providing a disturbance to said stream at said nozzle to produce a stream of liquid droplets monodispersed in a single line; and drive means for relative movement of said nozzle and said support for impacting liquid droplets of said stream onto said product collector in a predetermined pattern.

2. An apparatus as defined in claim 1 wherein said disturbance means includes means for providing a periodic disturbance to said stream.

3. An apparatus as defined in claim 1 wherein said disturbance means includes modulator means for providing an amplitude modulated disturbance to said stream.

4. An apparatus as defined in claim 1 including a plurality of said nozzles and a separate conduit means for each of said nozzles.

5. An apparatus as defined in claim 1 wherein said nozzle is a single stream nozzle.

6. An apparatus as defined in claim 1 wherein said nozzle is a multiple stream nozzle.

7. An apparatus as defined in claim 1 including a plurality of said nozzles and a separate conduit means for each of said nozzles, and wherein each of said nozzles is a multiple stream nozzle.

8. An apparatus as defined in claim 1 including means for controlling the environment in said chamber.

9. An apparatus as defined in claim 1 including a plurality of sources of liquid material under pressure, a plurality of nozzles, and a separate conduit means for connecting each of said nozzles to a separate one of said sources.

10. The apparatus as defined in claim 1 wherein said drive means includes means for rotating said produce collector about an axis, and means for moving said nozzle along said axis of rotation.

11. The apparatus as defined in claim 1 wherein said generator means includes first and second generators, each having a nozzle, and said conduit means includes first and second conduits for said first and second generators, respectively, with said nozzles positioned to provide colliding droplet streams for forming disks of said material.

12. The apparatus as defined in claim 1 including means for directing a flow of gas into said droplet stream.

13. An apparatus as defined in claim 8 including means for producing a vacuum in said chamber.

14. An apparatus as defined in claim 8 including means for providing a reactive gas flow in said chamber.

15. The apparatus as defined in claim 11 wherein said generators means includes means for varying the velocities of said streams.

16. The apparatus as defined in claim 12 wherein said means for directly includes means for directing said gas flow counter current to said droplet stream.

17. The apparatus as defined in claim 12 wherein said means for directing includes means for directing said gas flow along with said droplet stream.

18. In an apparatus for producing a stream of disk shaped droplets, the combination of:

a source of liquid material under pressure;

a chamber;

liquid droplet stream generator means positioned within said chamber, said generator means including first and second nozzles;

conduit means for conducting liquid material from said material source to each of said generator nozzles for producing intersecting streams;

modulator means for providing an amplitude modulated disturbance to said streams at said nozzles to produce first and second streams of liquid droplets, with each stream monodispersed in a single line and with droplets of the intersecting streams impacting to form dis-shaped droplets monodispersed in a single line; and means for maintaining a vacuum in said chamber.

19. The apparatus as defined in claim 18 wherein said generators means includes means for varying the velocities of said streams.

* * * * *